US010687159B2

(12) United States Patent
Yamaguchi et al.

(10) Patent No.: US 10,687,159 B2
(45) Date of Patent: Jun. 16, 2020

(54) NOISE REDUCTION DEVICE, NOISE REDUCTION SYSTEM, AND FAULT DETECTION METHOD FOR NOISE REDUCTION DEVICE

(71) Applicant: Panasonic Intellectual Property Management Co., Ltd., Osaka (JP)

(72) Inventors: Takahiro Yamaguchi, Osaka (JP); Toshihiro Ezaki, Osaka (JP); Kenichi Kubota, Osaka (JP); Masaru Matsuoka, Osaka (JP); Yuji Suzuki, Osaka (JP); Junji Araki, Osaka (JP); Shinichi Takayama, Fukuoka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 16/297,907

(22) Filed: Mar. 11, 2019

(65) Prior Publication Data

US 2019/0281398 A1 Sep. 12, 2019

Related U.S. Application Data

(60) Provisional application No. 62/641,417, filed on Mar. 12, 2018.

(51) Int. Cl.

| | |
|---|---|
| ***G10K 11/178*** | (2006.01) |
| ***H04R 29/00*** | (2006.01) |
| ***G10K 11/16*** | (2006.01) |

(52) U.S. Cl.

CPC ..... *H04R 29/00* (2013.01); *G10K 11/16* (2013.01); *G10K 11/17835* (2018.01);

(Continued)

(58) Field of Classification Search

CPC ..... G10K 11/178; G10K 2210/1282; G10K 11/17835; G10K 11/17833;

(Continued)

(56) References Cited

U.S. PATENT DOCUMENTS

| | | | | |
|---|---|---|---|---|
| 2008/0159553 | A1* | 7/2008 | Copley | G10K 11/178 381/71.1 |
| 2009/0268899 | A1* | 10/2009 | Tokuda | H04M 1/6033 379/420.02 |
| 2010/0111317 | A1 | 5/2010 | Asao et al. | |
| 2016/0034416 | A1* | 2/2016 | Chavez | G06F 1/266 381/59 |

(Continued)

FOREIGN PATENT DOCUMENTS

| | | |
|---|---|---|
| EP | 3 468 232 | 4/2019 |
| FR | 2 997 257 | 4/2014 |

(Continued)

OTHER PUBLICATIONS

Extended European Search Report dated Jul. 25, 2019 in European Application No. 19162268.7.

*Primary Examiner* — Paul Kim
*Assistant Examiner* — Ubachukwu A Odunukwe
(74) *Attorney, Agent, or Firm* — Wenderoth, Lind & Ponack, L.L.P.

(57) ABSTRACT

In a noise reduction device that generates and outputs a control sound signal for reducing noise, an internal loop control unit controls an internal loop in which a pre-output control sound signal that is acquired from a control sound output unit before output to a speaker is input to a sound receiver. A measurement unit measures an input level of a microphone sound signal and an input level of the pre-output control sound signal that has been input to the sound receiver in the internal loop. A fault detector uses the input level of the microphone sound signal and the input level of the pre-output control sound signal measured by the measurement unit to detect a fault in any one of the microphone, the sound receiver, the speaker, and the control sound output (Continued)

unit. A transmitter sends a result of fault detection performed by the fault detector to a management device.

14 Claims, 19 Drawing Sheets

(52) U.S. Cl.
CPC ..... *G10K 11/17881* (2018.01); *H04R 29/001* (2013.01); *H04R 29/004* (2013.01); *G10K 2210/1281* (2013.01); *G10K 2210/503* (2013.01); *H04R 2410/05* (2013.01)

(58) Field of Classification Search
CPC ..... G10K 2210/1281; H04R 29/00; H04R 29/004; H04R 29/001
USPC ..... 381/71.4, 71.1, 94.7, 58, 59; 379/420.02
See application file for complete search history.

(56) References Cited

U.S. PATENT DOCUMENTS

| | | | | |
|---|---|---|---|---|
| 2016/0055070 | A1 | 2/2016 | Ito | |
| 2017/0186417 | A1 | 6/2017 | Maeda et al. | |
| 2019/0149916 | A1* | 5/2019 | Takayama ..... | H04R 29/002 381/26 |

FOREIGN PATENT DOCUMENTS

| | | |
|---|---|---|
| JP | 5-333878 | 12/1993 |
| JP | 2000-172275 | 6/2000 |
| JP | 2002-288772 | 10/2002 |
| JP | 2007-145326 | 6/2007 |
| JP | 2011-123389 | 6/2011 |
| JP | 2016-45215 | 4/2016 |
| JP | 2017-116909 | 6/2017 |
| WO | 2017/203900 | 11/2017 |

* cited by examiner

FIG. 13A

| | M1 | M2 | M3 | M4 | M5 | M6 | M7 | M8 | M9 | M10 | ... | S1 | S2 | S3 | S4 |
|---|---|---|---|---|---|---|---|---|---|---|---|---|---|---|---|
| EXTERNAL LOOP | OK | OK | OK | OK | OK | NG | OK | NG | NG | OK | ... | OK | OK | NG | NG |
| INTERNAL LOOP | – | – | – | – | – | – | – | – | – | – | ... | – | – | – | – |
| | | | | | | | | | | | | | | | |

FIG. 13B

| | M1 | M2 | M3 | M4 | M5 | M6 | M7 | M8 | M9 | M10 | ... | S1 | S2 | S3 | S4 |
|---|---|---|---|---|---|---|---|---|---|---|---|---|---|---|---|
| EXTERNAL LOOP | OK | OK | OK | OK | OK | NG | OK | NG | NG | OK | ... | OK | OK | NG | NG |
| INTERNAL LOOP | OK | OK | OK | OK | OK | OK | OK | OK | NG | OK | ... | OK | OK | NG | OK |
| | | | | | | | | | | | | | | | |

FIG. 16

| INDEX | DATA |
|---|---|
| SEAT NUMBER | 7C |
| MODE | BED |
| ANGLE | 170 degrees |
| WEIGHT | 70 kg |
| ... | ... |

FIG. 17

| ANGLE OF SEAT | MODE |
|---|---|
| 110 TO 150 | UPRIGHT |
| 151 TO 160 | RELAX |
| 161 TO 180 | BED |

FIG. 18

| INDEX | DATA |
| --- | --- |
| ACTION | INCREASE |
| ... | ... |

FIG. 19

| INDEX | DATA |
| --- | --- |
| UP BUTTON | PUSH |
| DOWN BUTTON | NONE |
| ... | ... |

NOISE REDUCTION DEVICE, NOISE REDUCTION SYSTEM, AND FAULT DETECTION METHOD FOR NOISE REDUCTION DEVICE

CROSS-REFERENCE TO RELATED APPLICATION

This application claims benefit to U.S. provisional application No. 62/641,417, filed on Mar. 12, 2018. The entire disclosure of U.S. provisional application 62/641,417 is hereby incorporated herein by reference.

BACKGROUND

Technical Field

The present disclosure relates to a noise reduction device, a noise reduction system and a fault detection method for the noise reduction device.

Background Art

There is known a noise reduction device in which a plurality of microphones are arranged around a movable (reclining) seat and speakers output a control sound that reduces the noise acquired by the microphones. US Patent Application No. 2010/111317A discloses an example of such a device.

A moving body for ordinary passenger transportation such as aircraft or a railroad vehicle makes it possible to transport a large number of passengers at one time by disposing a plurality of seats in one cabin or car. When an aircraft or railroad vehicle travels at high speed, various types of noise are generated at different places in the vehicle due to vibration caused by the engine or motor that drives the vehicle, air colliding with the structure of the vehicle, and other such phenomena. How this noise travels to each seat, the volume (amplitude) of the noise at each seat, and how long the noise takes to reach each seat (phase) differs depending on where the seat is located in the cabin or car. Therefore, a noise reduction system that captures noise and generates a control sound that cancels out the noise is ideally located in each seat.

However, a single noise reduction device is connected to a plurality of speakers and a plurality of microphones that are embedded into a seat cover, for example. Therefore, if one of the speakers or microphones breaks down, it can be difficult or impossible to identify which device is faulty. This causes problems in terms of maintenance.

BRIEF SUMMARY

The present disclosure provides a noise reduction device, a noise reduction system and a fault detection method for the noise reduction device that are useful for making maintenance more efficient.

The noise reduction device according to the present disclosure is a noise reduction device that generates and outputs a control sound signal for reducing noise and includes a sound receiver, a control sound output unit, a control sound generator, an internal loop control unit, a measurement unit, a fault detector, and a transmitter. The sound receiver receives a microphone sound signal acquired by a microphone. The control sound output unit outputs a control sound signal to a speaker. The control sound generator generates the control sound signal on the basis of the microphone sound signal and generates a predetermined signal. The internal loop control unit controls a pre-output control sound signal to be input to the sound receiver, the pre-output control sound signal being acquired from the control sound output unit prior to being output to the speaker. The measurement unit measures an input level of the microphone sound signal and an input level of the pre-output control sound signal that has been input to the sound receiver in the internal loop. The fault detector uses the input level of the microphone sound signal measured by the measurement unit and the input level of the pre-output control sound signal measured by the measurement unit to detect a fault in at least one of the microphone, the sound receiver, the speaker, and the control sound output unit. The transmitter transmits results of the fault detection performed by the fault detector to a management device.

The fault detection method according to this disclosure is a fault detection method for a noise reduction device that generates and outputs a control sound signal for reducing noise, the method including: receiving a microphone sound signal acquired by a microphone by a reception circuit; outputting a control sound signal to a speaker by an output circuit; generating the control sound signal on the basis of the microphone sound signal; generating a predetermined signal; measuring an input level of a pre-output control sound signal, which is a control sound signal acquired before output to the speaker; measuring an input level of the microphone sound signal; detecting a fault in at least one of the microphone, the reception circuit, the speaker, and the output circuit, using the input level of the microphone sound signal and the input level of the pre-output control sound signal; and sending results of fault detection to a management device.

BRIEF DESCRIPTION OF DRAWINGS

FIG. 13A illustrates an example of results of fault detection using the noise reduction device according to the first embodiment.

FIG. 13B illustrates an example of results of fault detection using the noise reduction device according to the first embodiment.

FIG. 16 illustrates an example of seat information according to the second embodiment.

FIG. 17 illustrates exemplary information for identifying the reclined state of a seat according to the second embodiment.

FIG. 18 illustrates an exemplary control command that is output from a seat control system according to the second embodiment.

FIG. 19 illustrates exemplary instruction information in the seat control system according to the second embodiment.

DETAILED DESCRIPTION

Embodiments are described below with reference to the figures as needed. Any explanations deemed unnecessary, such as detailed descriptions of well-known aspects or duplicate descriptions of substantially identical components, may be omitted from this disclosure.

Note that the appended figures and following description are merely provided to allow a person having skill in the art to fully understand the present disclosure and are not intended to limit the subjects described in the claims.

First, the acoustic environment in an aircraft 100, which requires the installation of noise reduction devices, is described with reference to FIGS. 1 and 2.

Figure 1:
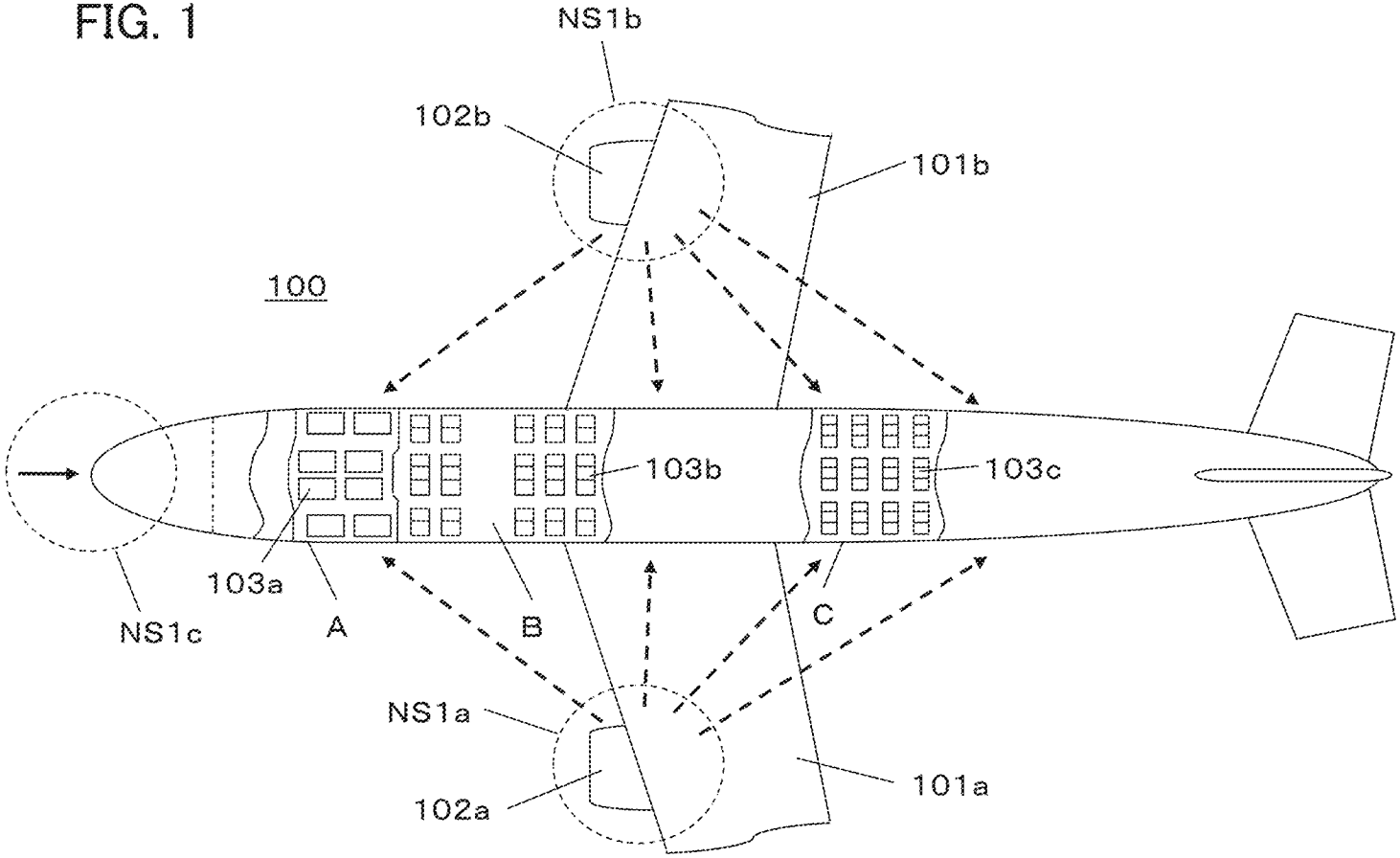
FIG. 1 schematically illustrates an aircraft in which noise reduction devices according to a first embodiment are installed.

FIG. 1 is a plan view for illustrating an environment (inside the aircraft 100) in which noise reduction devices according to this embodiment are installed.

As illustrated in FIG. 1, the aircraft 100 includes left and right wings 101*a* and 101*b*, and engines 102*a* and 102*b* that are mounted to the wings 101*a* and 101*b*, respectively.

In terms of acoustic environment, the space inside the aircraft 100 is greatly affected by noise generated by the engines 102*a* and 102*b*. This noise includes both noise of the engines rotating and reverberation of air that passes through the engines during flight.

The engines 102*a* and 102*b* act as, for example, external noise sources NS1*a* and NS1*b* relative to rows of seats 103*a*. 103*b*, and 103*c* respectively located in a seating cabin A (for example, first class), a seating cabin B (for example, business class), and a seating cabin C (for example, economy class) in the aircraft. In addition, the noise (wind roar) of air colliding with the tip and sides of the body of the aircraft and the wings 101*a* and 101 *b* when the aircraft 100 travels at high speed acts as a noise source NS1*c* and adversely affects the provision of information services and the like in the aircraft 100.

In addition, the aircraft 100 includes an air-conditioning system (not shown) equipped with pressurization, ventilation and temperature regulation functions in order to clean, maintain and circulate the air inside the aircraft 100. As described later, noise emitted from this air conditioning system acts as a noise source alongside the noise sources NS1*a*, NS1*b*, and NS1*c*.

Figure 2:
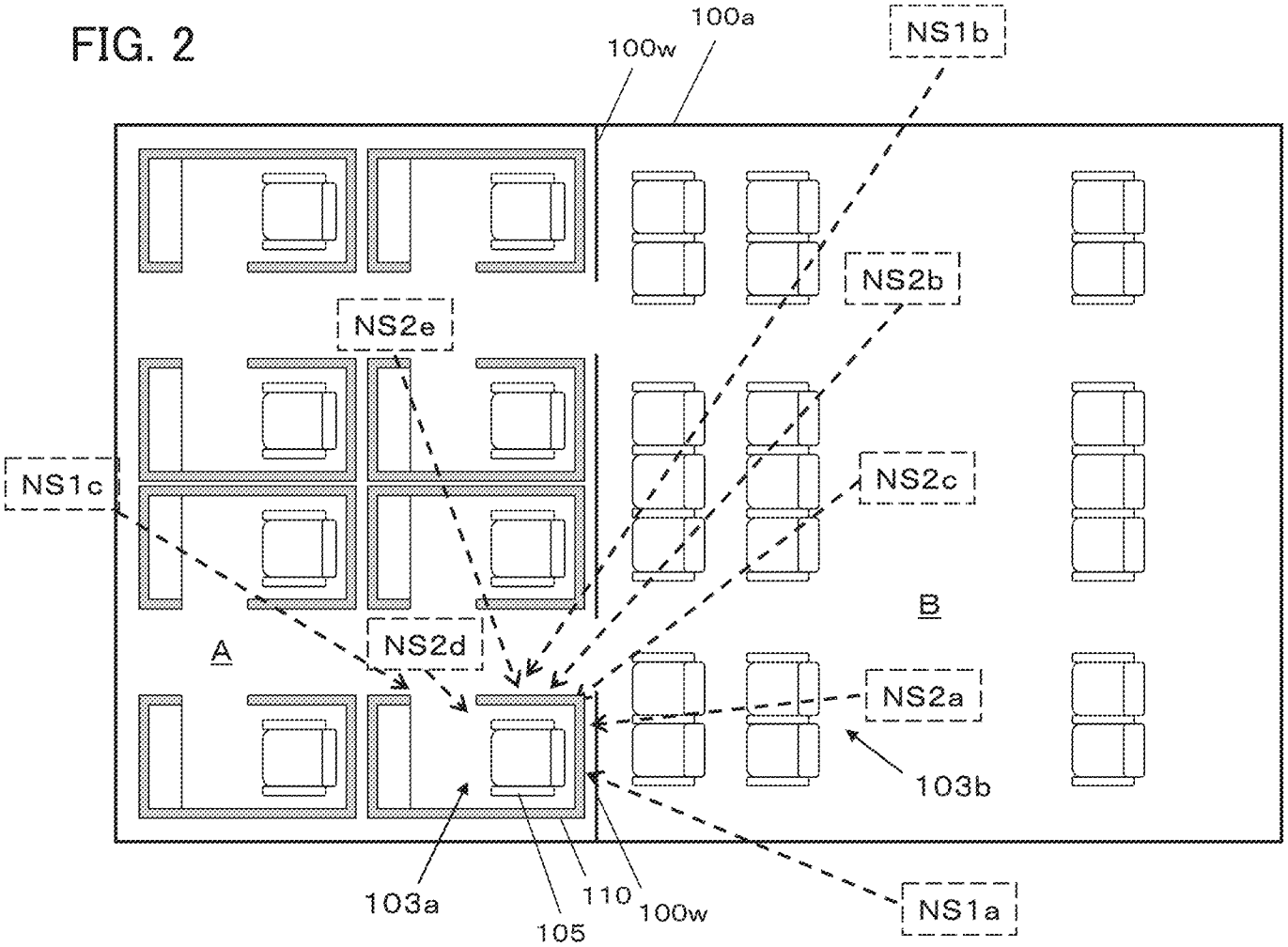
FIG. 2 illustrates an example of an environment in an aircraft in which the noise reduction devices according to the first embodiment are installed.

FIG. 2 is a plan view for illustrating in detail the environment in which the noise reduction devices are installed. FIG. 2 illustrates an expanded view of some of the seating in the seating cabins A and B illustrated in FIG. 1.

The entire seating cabin 100*a* is partitioned into the seating cabin A and the seating cabin B by walls 100*w*. Seating rows 103*a* and 103*b* are located in the seating cabin A and the seating cabin B, respectively.

The acoustic environment in the entire seating cabin 100*a* includes the noise sources NS1*a* and NS1*b* generated by the engines 102*a* and 102*b*, and wind roar (noise source NS1*c*) at the tip, side surfaces and wings of the aircraft body. The entire seating cabin 100*a* is also affected by the noise sources NS2*a* to NS2*e* generated by the air-conditioning system and other components.

For example, one seat 105 in the seating cabin A is affected by the noise sources NS1*a* to NS1*c* generated by the sound of airflow and the engines 102*a* and 102*b* (see FIG. 1) mounted to the wings on the outside of the window, and noise from the noise sources NS2*a* to NS2*e* that is generated by the air-conditioning system or other components.

Figure 3:
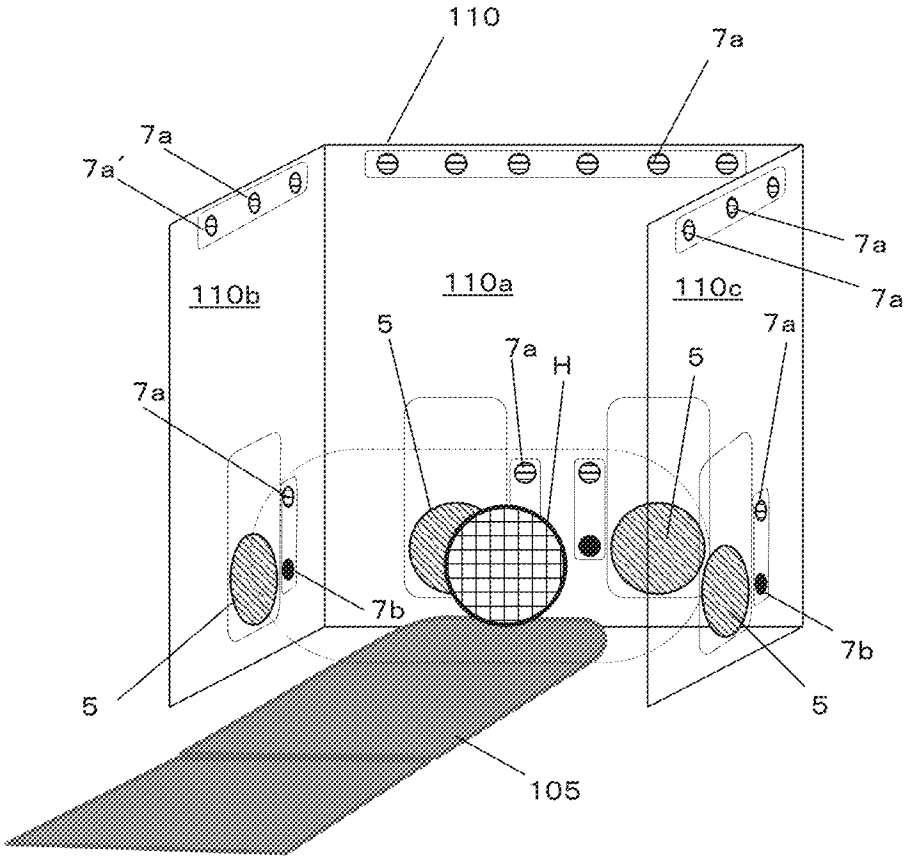
FIG. 3 illustrates an example of a shell structure in which the noise reduction device according to the first embodiment is used.

First class seats, such as the seat 105, in the seating cabin A illustrated in FIG. 1 are each surrounded by a shell structure 110 such as that illustrated in FIG. 3. This shell structure 110 includes audio/visual devices such as a television and/or a radio for the passenger to enjoy movies and/or music, a desk for business purposes, a power source for plugging in a computer, and other such devices.

Figure 4:
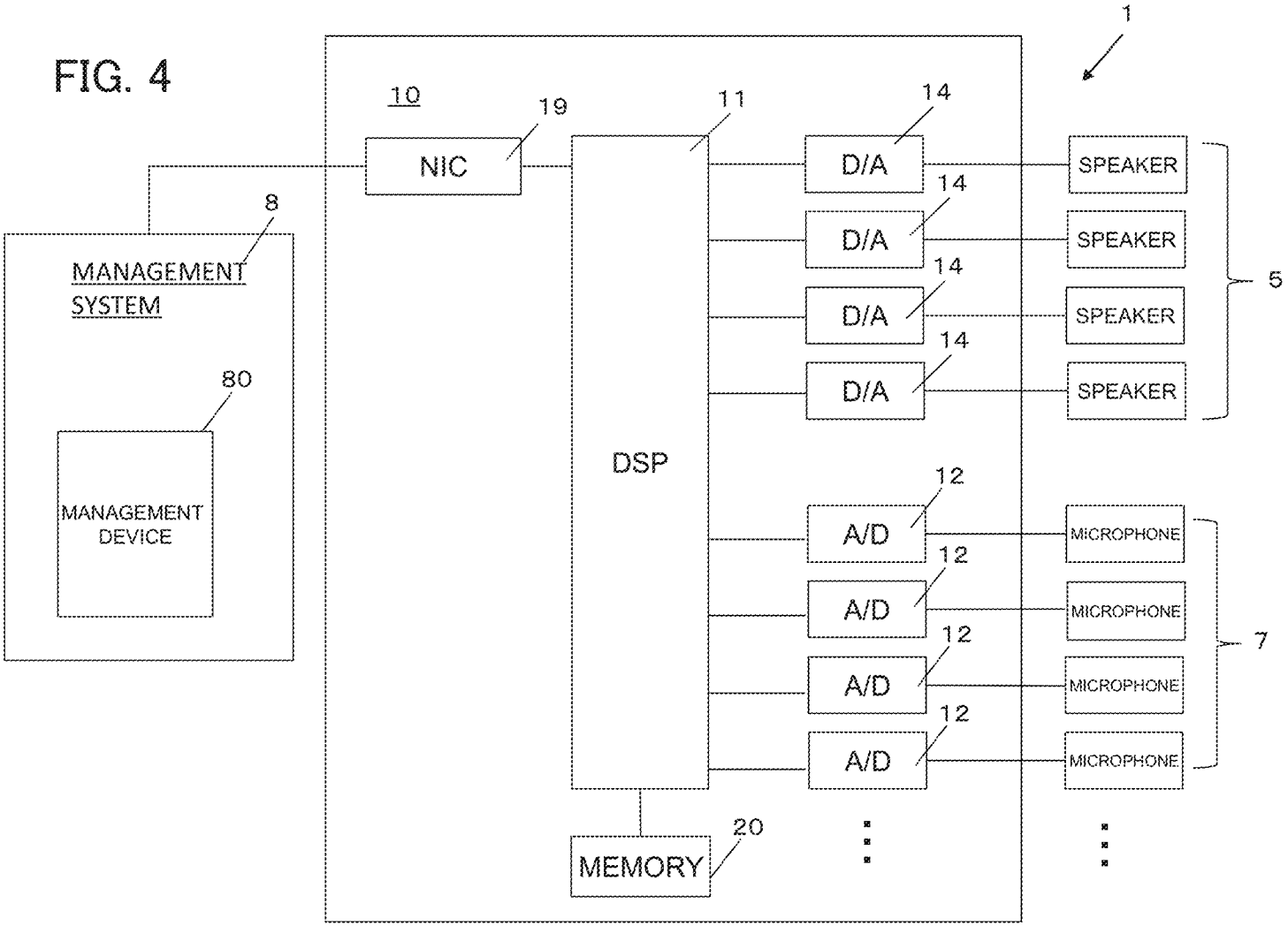
FIG. 4 schematically illustrates the configuration of a noise reduction system according to the first embodiment.

As illustrated in FIG. 3, the seat 105 is installed within walls (rear wall 110*a* and side walls 110*b* and 110*c*) of the shell structure 110. The seat 105 is movable and adjustable seamlessly from an upright position to a fully-flat position, or be moved from the upright position in stages at different seating angles. FIG. 3 illustrates the seat 105 in the fully-flat position for ease of understanding. The fully-flat position is a state in which the backrest of the seat 105 has been reclined backward and the passenger can lie down on the seat 105. The seat 105 and the walls 110*a* to 100*c* all include noise reduction systems 1 (FIG. 4).

In the following description, the microphones 7 are classified into noise microphones 7*a* and error microphones 7*b*. The noise microphone 7*a* is a microphone that detects sound emitted from a noise source. The error microphone 7*b* is a microphone that detects residual noise (error noise) that occurs when a noise emitted from a noise source overlaps with a control sound that is output from a speaker 5. The control sound is a sound signal that is generated to cancel out noise.

1. Embodiment 1

1-1. Configuration

A noise reduction system 1 including a noise reduction device 10 according to Embodiment 1 is described with reference to FIGS. 3 to 13, taking an example where the noise reduction system 1 is installed in an aircraft 100.

The noise reduction system 1 sends a notification of information (hereinafter referred to as "fault detection information") that indicates results of fault detection by the noise reduction device 10 to a management device 80 of a management system 8 in the aircraft 100. The management device 80 manages the fault detection information to make maintenance more efficient.

FIG. 4 is an illustration of the entire configuration of the noise reduction system 1. The noise reduction system 1 is a system that is installed in the aircraft 100 and includes a plurality of speakers 5, a plurality of microphones 7 and the noise reduction device 10.

Figure 5:
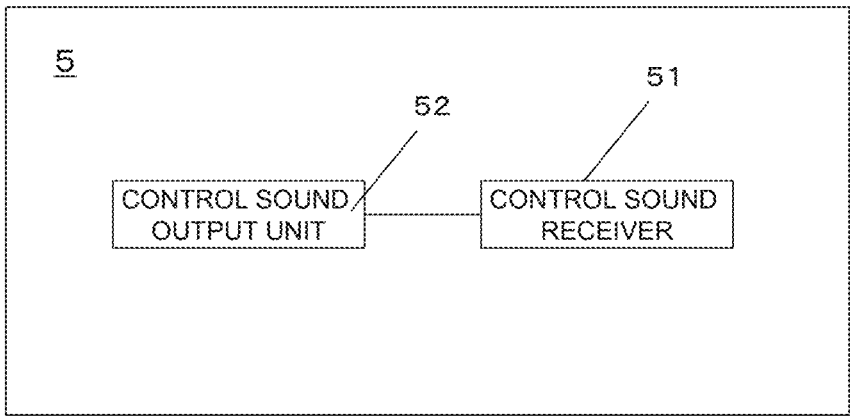
FIG. 5 is a block diagram for illustrating the function of a speaker according to the first embodiment.

As illustrated in FIG. 5, each speaker 5 includes a control sound receiver 51 and a control sound output unit 52. The control sound receiver 51 receives a control sound signal that is transmitted from the noise reduction device 10. The control sound output unit 52 amplifies and outputs a control sound.

Figure 6:
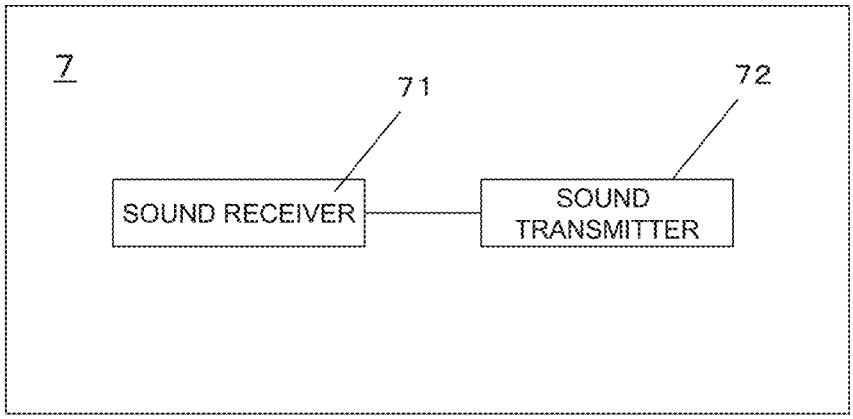
FIG. 6 is a block diagram for illustrating the function of a microphone according to the first embodiment.

As illustrated in FIG. 6, each microphone 7 includes a sound receiver 71 and a sound transmitter 72. The sound receiver 71 acquires sound that is emitted from a noise source and sound that is emitted from each speaker 5. The sound transmitter 72 converts the sound acquired by the sound receiver 71 into electrical signals and transmits the electrical signals to the noise reduction device 10 as sound signals.

As illustrated in FIG. 3, the plurality of speakers 5 and plurality of microphones 7 are disposed at predetermined positions in the walls 110*a* to 110*c* of the shell structure 110 that surrounds the seat 105. FIG. 3 illustrates an example where the plurality of speakers 5 and plurality of microphones 7 are located at the bottom of the shell structure 110, which is an effective layout when the seat 105 is in a bed mode (a fully-flat position). However, the plurality of speakers 5 and plurality of microphones 7 may be disposed at different positions.

The noise reduction device 10 is disposed inside the seat 105, for example, below the seat surface of the seat 105. As illustrated in FIG. 4, the noise reduction device 10 includes D/A conversion circuits 14 that correspond with speakers 5 respectively, A/D conversion circuits 12 that correspond with microphones 7 respectively, a digital signal processor (DSP) 11, and a network card 19.

The D/A conversion circuit 14 (example of a control sound output unit or an output circuit) functions as a control sound output unit (described later). The D/A conversion circuit 14 converts control sound generated by the DSP 11 from a digital signal to an analog signal and outputs the analog signal to the speaker 5. The A/D conversion circuit 12 (example of a sound receiver or a reception circuit) functions as a sound receiver (described later). The A/D conversion circuit 12 converts sound recorded by the microphone 7 from an analog signal into a digital signal and inputs the digital signal to the DSP 11.

The network card 19 (example of a transmitter) includes a circuit or a terminal that communicates with the management device 80. The network card 19 transmits fault detection information and other information to the management device 80.

Figure 7:
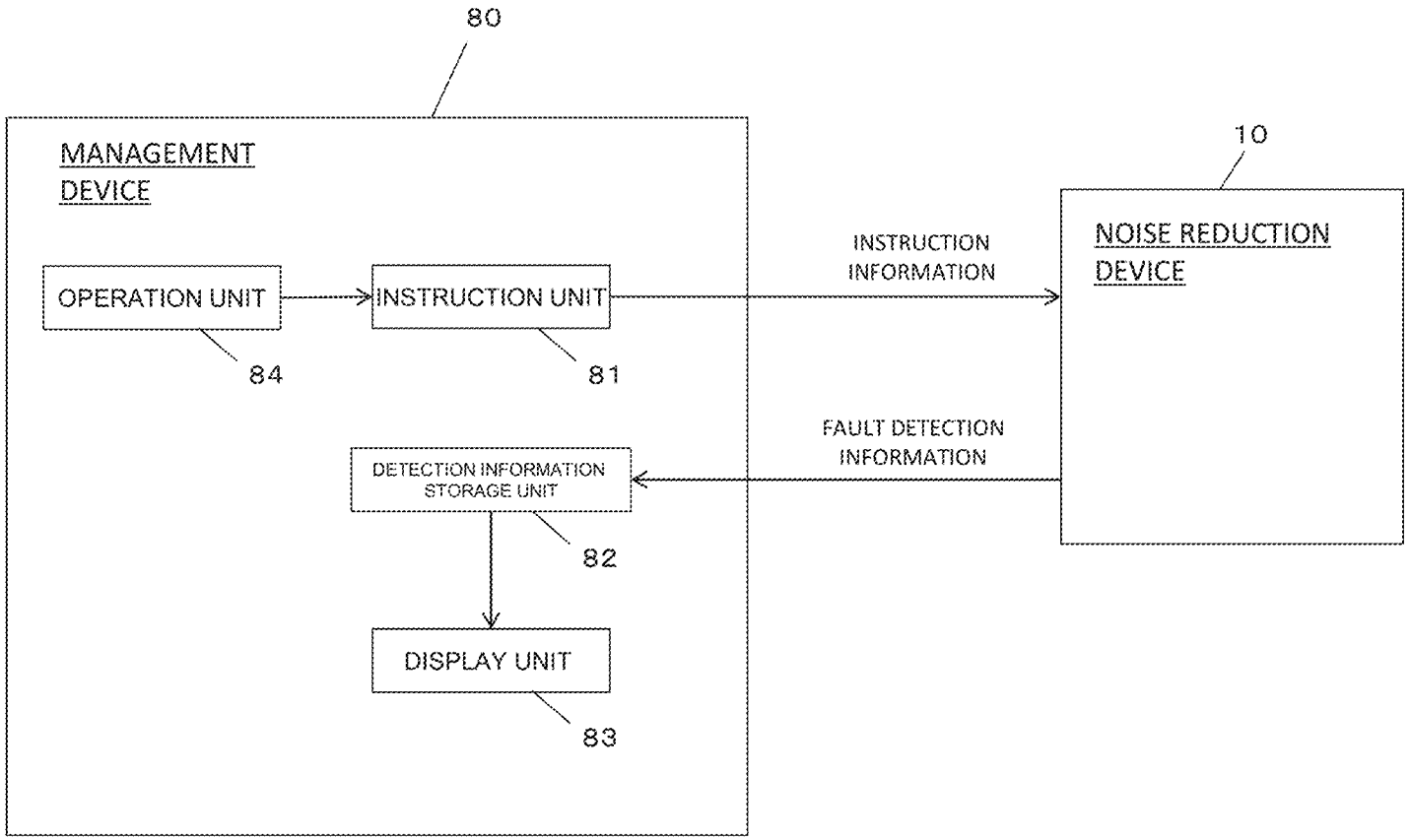
FIG. 7 is a block diagram for illustrating the function of a management device according to the first embodiment.

The noise reduction system 1 may further include the management device 80 as part of the management system 8 in the aircraft 100. The management device 80 includes a processor with a control circuit, such as a CPU, and a memory and may be a computer that operates according to a predetermined program. As illustrated in FIG. 7, the management device 80 includes an instruction unit 81, a detection information storage unit 82, a display unit 83, and an operation unit 84. The instruction unit 81 is implemented by a processor that runs a predetermined program and, as described later, sends a run instruction for fault detection processing or other processing to the noise reduction device 10. The detection information storage unit 82 is implemented by a memory and stores the fault detection information and other information that is transmitted from the noise reduction device 10. The display unit 83 is implemented by a liquid crystal display or an organic EL display and displays the fault detection information and other information. The operation unit 84 is implemented by devices such as a mouse, a keyboard or a touch panel disposed on the display unit 83 that are operated by the cabin crew of the aircraft 100 or maintenance staff responsible for the noise reduction system 1. The instruction unit 81 generates an instruction related to fault detection processing or other processing in response to operation of the operation unit 84 and may transmit that instruction to the noise reduction device 10. Alternatively, the instruction unit 81 may generate an instruction related to fault detection processing or other processing according to a timer or schedule and transmit the instruction to the noise reduction device 10.

The management device 80 further acquires, updates and stores management information on the aircraft 100. This management information includes operational information (estimated arrival time, departure time, velocity, direction of travel, etc.) and positional information (longitude, latitude, altitude, etc.) on the aircraft 100, seat information (seat number, etc.) and other such information.

The management device 80 may be one device or may be made up of a plurality of devices. For example, the display unit 83 and the operation unit 84 may be implemented by a computer terminal that is connected to the management device 80.

Next, the configuration of the noise reduction device 10 is described in detail.

1-1-1. Configuration for Executing Noise Reduction Processing

Figure 8:
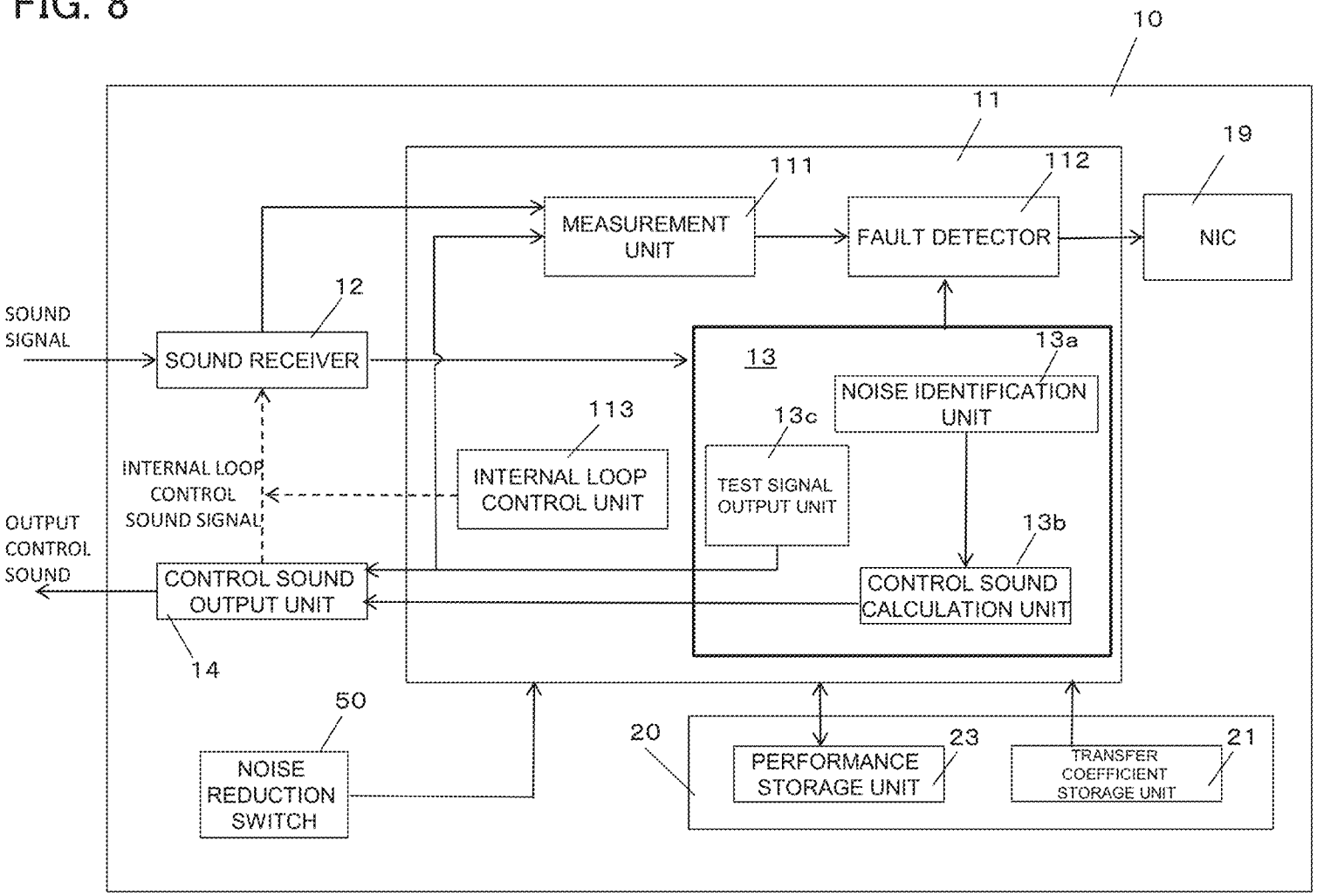
FIG. 8 is a block diagram for illustrating the function of the noise reduction device according to the first embodiment.

In the noise reduction device 10 illustrated in FIG. 8, the DSP 11 runs a predetermined program to execute noise reduction processing. The DSP 11 includes a digital filter such as a finite impulse response (FIR) filter or an adaptive filter that processes sound signals output from the microphones 7. The DSP 11 processes digital signals according to a predetermined program to implement the function of a control sound generator 13. The control sound generator 13 includes a noise identification unit 13*a* and a control sound calculation unit 13*b*. The noise identification unit 13*a* performs frequency analysis on sound signals output from the noise microphones 7*a* (FIG. 3), which are some of the plurality of microphones 7, to identify noise signals among the sound signals acquired from the noise microphones 7*a*. These noise signals are in a frequency band that is to be cancelled. The control sound calculation unit 13*b* reads a transfer coefficient that is stored in a transfer coefficient storage unit 21 in the memory 20. The transfer coefficient is a coefficient that is based on the transfer function from the speaker 5 to the error microphone 7*b* (FIG. 3). The control sound calculation unit 13*b* generates a control sound signal with a phase opposite to that of a noise signal that has been advanced by the transfer coefficient. For example, the control sound calculation unit 13*b* adjusts the filter coefficient of the digital filter such that error sound emitted from the error microphones 7*b* among the microphones 7 reaches a minimum. This adjustment minimizes the error between the control sound and noise at the control point (for example, the position of the head H of a passenger in the seat illustrated in FIG. 3) and maintains the effect of reducing noise.

In the noise reduction device 10 illustrated in FIG. 8, the sound receivers 12 including the A/D conversion circuits receive sound signals from microphones 7 respectively and performs A/D conversion and encoding on the sound signals. The sound receivers 12 have the same number of channels as the number of microphones 7. The control sound output units 14 including the D/A conversion circuits have the same number of channels as the number of speakers 5 and converts the control sound signals generated by the control sound generator 13 from digital to analog. Then, the control sound output unit 14 outputs the converted control sound signals to the speaker 5 respectively. The control sound output from the speakers 5 reduces noise around the passenger in the seat.

The noise reduction device 10 includes a noise reduction switch 50. The noise reduction switch 50 switches the above-described noise reduction processing ON/OFF in the noise reduction device 10. This instruction to switch ON/OFF may be generated and output when the passenger operates an operation button or touch panel disposed in the seat 105.

1-1-2. Configuration for Executing Fault Detection Processing

In the noise reduction device 10 illustrated in FIG. 8, the DSP 11 runs a predetermined program to execute fault detection processing. As described later, the fault detection processing includes an external device test and an internal device test that are performed before the noise reduction processing begins, and a noise reduction performance test.

The external device test and the internal device test involve checking if any of the sound receiver 12, the control sound output unit 14, the speakers 5 and the microphones 7 in the noise reduction device 10 are faulty or malfunctioning and identifying a faulty device. In the external device test and the internal device test, the DSP 11 performs the functions of a measurement unit 111, a fault detector 112, an internal loop control unit 113, and a test signal output unit 13*c*.

The measurement unit 111 measures the input level of a sound signal (referred to as "microphone sound signal" herein) received from the microphone 7. The input level is, for example, a sound pressure level. The measurement unit 111 also measures the input level of a control sound signal (referred to as "pre-output control sound signal" herein) before that control sound signal is output to the speaker 5. The control sound signal is input to the sound receiver 12 using an internal loop, which is described later.

The fault detector 112 uses the input level of the microphone sound signal measured by the measurement unit 111 and the input level of the pre-output control sound signal measured by the measurement unit 111 to detect a fault in at least one of the microphone 7, the sound receiver 12, the speaker 5, and the control sound output unit 14.

The test signal output unit 13*c* outputs white noise (example of a predetermined signal).

The internal loop control unit 113 enables or disables an internal loop in which the pre-output control sound signal is input to the sound receiver 12. When the internal loop is enabled, the internal loop control unit 113 turns OFF output to the speaker 5 of the corresponding control sound output unit 14 and input to the sound receiver 12 from the corresponding microphone 7.

In the noise reduction performance test, the noise identification unit 13*a* of the control sound generator 13 identifies a noise signal in a frequency band that is to be cancelled from among the sound signals acquired from the noise microphones 7*a* (FIG. 3) and stores the noise level (example of a predetermined noise level) of the identified frequency band in a performance storage unit 23 in the memory 20. If, for example, the noise level at 100 Hz is 90 dB, a noise level 90 dB is stored in the performance storage unit 23. Other noise level references may be used to measure noise. For example, an A-weighted sound pressure level (A characteristic), a sound pressure level with a flattened characteristic without frequency weighting, a C-weighted sound pressure level that is weighted with frequency compensation characteristics, or another sound pressure index may be used.

The control sound calculation unit 13*b* of the control sound generator 13 acquires noise level in a frequency band of error noise acquired from the error microphones 7*b* (FIG. 3). The control sound calculation unit 13*b* compares the noise level of the error noise acquired by the control sound calculation unit 13*b* and the noise level stored in the performance storage unit 23. If the noise level of the error noise acquired by the control sound calculation unit 13*b* is, for example, 75 dB, the noise level is compared to the noise level 90 dB that is stored in the performance storage unit 23. Then, a noise reduction value 15 dB, which is the difference between the two levels, is calculated. The calculated noise reduction value is stored with the predetermined noise level 90 dB in the performance storage unit 23.

Note that the performance storage unit 23 may store a noise reduction threshold value for determination (example of a predetermined threshold) in advance. The noise reduction threshold value for determination is a reference for determining the effect of noise reduction and is, for example, 5 dB. When calculating the noise reduction value, the control sound calculation unit 13*b* compares the noise reduction value and the noise reduction threshold value for determination. If the noise reduction value is less than the noise reduction threshold value for determination, the noise reduction device 10 sends noise reduction information to the management device 80. This noise reduction information includes the noise reduction threshold value for determination and the noise reduction value. The noise reduction information may be displayed on the display unit 83. The noise reduction information may include, in addition to the noise reduction threshold value for determination and the noise reduction value, information on the time, positional information (longitude, latitude, altitude, etc.) and travel information (velocity, angle of travel, etc.) on the aircraft 100, the noise level inside the aircraft 100, seat information (seat numbers, reclining states, etc.) or other information, at which the noise reduction value was acquired.

In the example described above, the noise level of sound acquired by the noise microphone 7*a* (FIG. 3) is compared to the noise level of error noise acquired by the error microphone 7*b* (FIG. 3) to obtain the noise reduction value, but a different method may be used to obtain the noise reduction value. For example, the noise microphone 7*a* that is furthest away from any of the installed speakers 5 may be selected to acquire a predetermined noise level, and the noise level of the microphone sound signal output from that noise microphone 7*a* may be used as the predetermined noise level. For example, the noise microphone 7*a*' in the example illustrated in FIG. 3 may be selected. The noise microphone 7*a*' that is furthest away from the speakers 5 is thought to have the least effect on the control sound output from the speakers 5. Therefore, the noise levels to be compared can be made more accurate.

As described later, a method may be used where the noise level of sound acquired by the error microphone 7*b* before executing noise reduction processing or processing of starting up the system is obtained in advance, and then compared with the noise level of error sound acquired by the error microphone 7*b* after noise reduction has been performed. Instead, noise reduction processing may be temporarily stopped while in progress to calculate and acquire the noise level using sound acquired by the error microphone 7*b*. This noise level may be used as the noise reduction value.

In the example described above, a notification of the noise reduction information is sent to a host system such as the management system 8 when it is determined that the noise reduction value has fallen below the noise reduction threshold value for determination, but the present disclosure is not limited thereto. The noise reduction system 1 may be configured to automatically restore its functions through readjustment. Note that a summary of this recovery processing may be sent to the management device 80 in addition to the noise reduction information.

The noise reduction system 1 may perform the noise reduction performance test according to a noise reduction performance confirmation instruction sent from the host system (for example, the management system 8). In addition, when the noise reduction system 1 receives the noise reduction performance confirmation instruction from the host system, the noise reduction system 1 may send a notification of all or some results of noise reduction performance from among the results of tests performed in the past.

1-2. Operation

Figure 9:
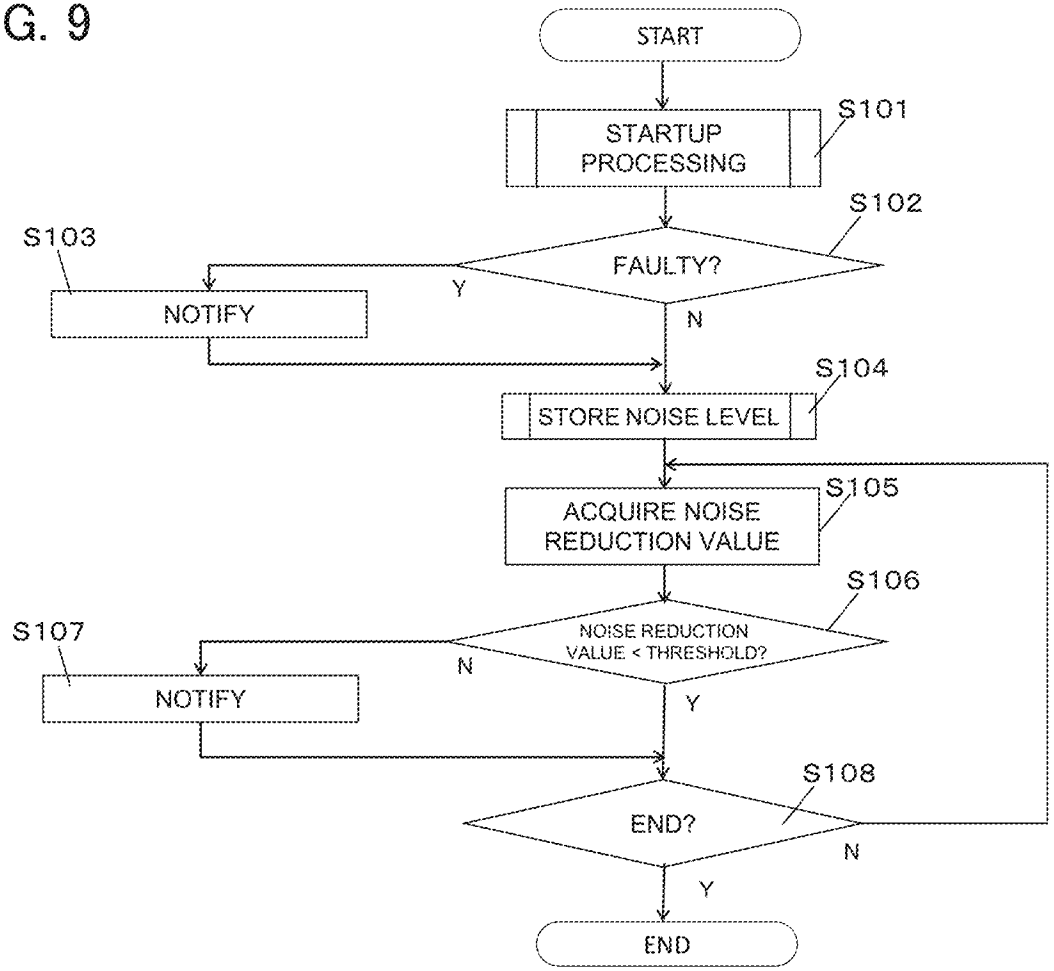
FIG. 9 is a flowchart for illustrating operation of detecting faults using the noise reduction device according to the first embodiment.

FIG. 9 is a flowchart for illustrating the entire operation of fault detection performed by the noise reduction system 1 according to Embodiment 1. The noise reduction device 10 illustrated in FIG. 8 receives an instruction to execute noise reduction processing from the instruction unit 81 (FIG. 7) of the management device 80 in the management system 8. Upon receiving this instruction, the noise reduction device 10 performs the above-described external device test and internal device test before starting the noise reduction operation.

The noise reduction system 1 is in an initialized state. During startup processing, the noise reduction device 10 performs the external device test and the internal device test (S101).

Figure 10:
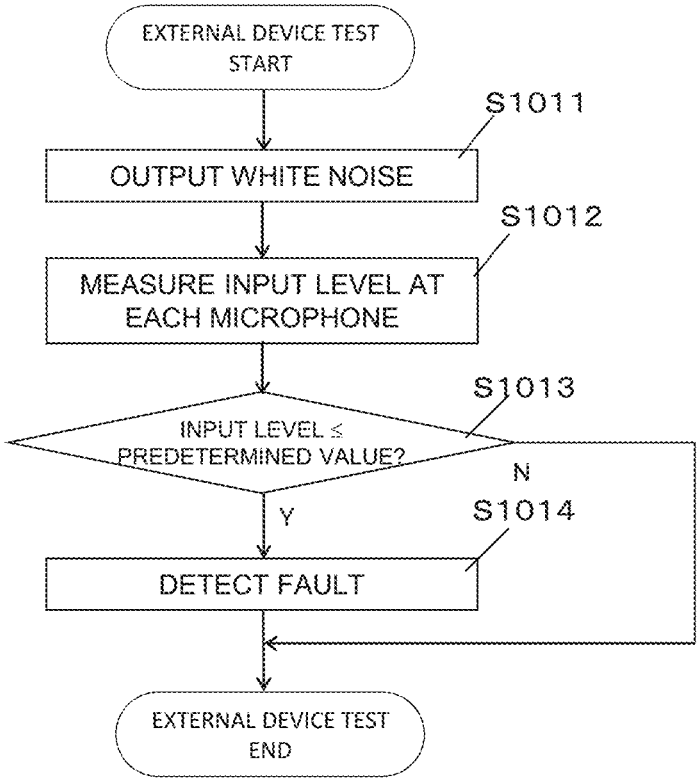
FIG. 10 is a flowchart for illustrating operation of detecting faults using the noise reduction device according to the first embodiment.

FIG. 10 is an illustration of processing for the external device test that is performed in Step S101. The test signal output unit 13*c* outputs white noise as a control sound signal (S1011) and sends the white noise from the control sound output units 14 to each corresponding speaker 5. The microphones 7 acquire the white noise that is output from the speakers 5 via corresponding sound receivers 12. The measurement unit 111 measures the input level of the sound signal (white noise) output from each microphone 7 (S1012). If the input level is less than or equal to a predetermined value (Yes in Step 1013), the fault detector 112 proceeds to Step S1014. The predetermined value is the value of a level at which the noise level can be identified and control sound can be generated. If the input level is less than or equal to the predetermined value, the fault detector 112 determines that the corresponding microphone 7 or sound receiver 12 is faulty (S1014). Steps S1011 to S1014 are performed for each microphone 7 and corresponding sound receiver 12.

The noise reduction system 1 according to this embodiment includes four speakers and 20 microphones and checks the input level of the sound signal output from each microphone 7. If the input level is low, the noise reduction system 1 can determine that a microphone 7 and corresponding sound receiver, or a speaker 5 and corresponding control sound output unit 14, are faulty.

As illustrated in FIG. 13A, results of the external device test are determined by the fault detector 112 and determination results ("OK" meaning no fault and "NG" meaning fault) are sequentially stored in the memory 20. During the external device test, the sound signals from speakers 5 may be output simultaneously or time control may be performed such that the speakers 5 output sound signals at different times. If controlling the output timing, the control sound calculation unit 13*b* can determine if a particular speaker 5 or microphone 7 is faulty) using the sound signal acquired by each microphone 7 and the time information.

The noise reduction device 10 sends information on the detected fault to the management device 80 as external loop fault information.

The test signal output unit 13*c* is configured to output white noise as the control sound signal, the control sound signal may be another type of noise. For example, a repetitive sound at a particular frequency may be used. When using a repetitive sound at a particular frequency, the speakers 5 may be made to output different repetitive sounds at different frequencies and then the input level of the sound signal at each frequency may be acquired from each microphone 7 and checked. As a result, a pair of speakers 5 and microphones 7 for which a series of operations involving sound output and sound signal acquisition has been confirmed can be identified. The speaker 5 and microphone 7 for which such an operation has not been confirmed may be identified as faulty devices. When using repetitive sounds at different frequencies, the repetitive sounds at different frequencies can be output from the speakers 5 simultaneously to shorten the time required for the external device test.

Figure 11:
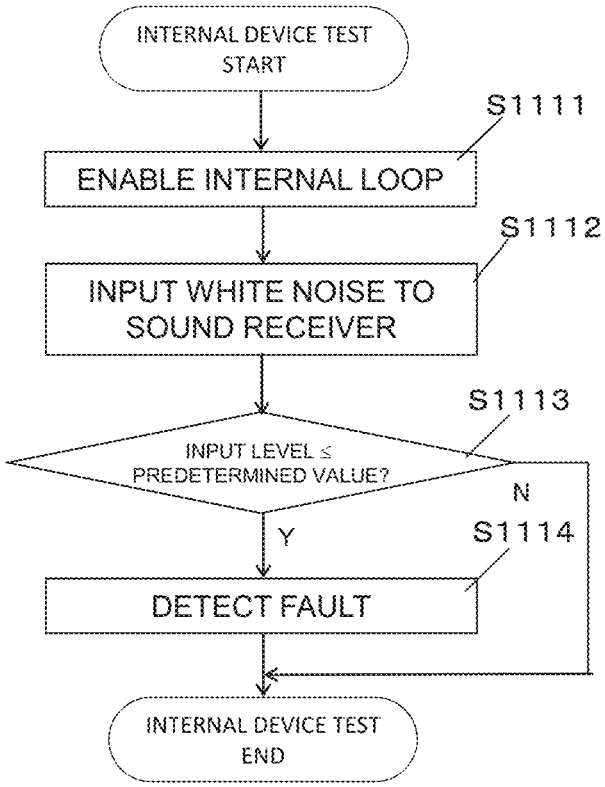
FIG. 11 is a flowchart for illustrating operation of detecting faults using the noise reduction device according to the first embodiment.

FIG. 11 is an illustration of processing for the internal device test that is executed in Step S101.

It can be difficult to determine which microphone or corresponding sound receiver 12, or speaker 5 or corresponding control sound output unit 14, is faulty using the external loop fault information. Therefore, in the internal device test, an operation test is only performed within the noise reduction device 10 and the sound receiver 12 and the control sound output unit 14 are checked for faults.

In the internal device test, an internal loop in which control sound signals are directly input from each control sound output unit 14 to a corresponding sound receiver 12 is enabled. The internal loop control unit 113 turns OFF output from the control sound output unit 14 to a corresponding speaker 5 and turns OFF input to the sound receiver 12 from a corresponding microphone 7. The internal loop control unit 113 enables the internal loop by using output from the control sound output units 14 as input to the sound receivers 12 (S1111).

In this state, the test signal output unit 13*c* outputs white noise as control sound signals to the control sound output units 14. The control sound signals are then input to the sound receivers 12 respectively (S1112). The measurement unit 111 measures the input levels of the sound signals of the sound receivers 12 and, if a measured input level is less than or equal to a predetermined value (Yes at S1113), the fault detector 112 determines that the corresponding sound receiver 12 is faulty (S1114). Steps S1111 to S1114 are performed for each microphone 7 and corresponding sound receiver 12.

The noise reduction device 10 sends information on the detected fault to the management device 80 as internal loop fault information.

While it is possible to determine if a speaker 5 or microphone 7 is faulty using the external loop fault information, as illustrated in FIG. 13B, which part of the speaker 5, microphone 7 or noise reduction device 10 (sound receiver 12 or control sound output unit 14) is faulty can be identified by combining the external loop fault information with the internal loop fault information. For example, the microphone M6 illustrated in FIG. 13B is determined to be faulty (NG) based on the external loop fault information and determined to be not faulty (OK) based on the internal loop fault information. As a result, it can be determined that the microphone M6 is faulty. On the other hand, the microphone M9 illustrated in FIG. 13B is determined to be faulty (NG) based on both the external loop fault information and the internal loop fault information. Thus, it can be determined that at the very least the sound receiver 12 corresponding to the microphone M9 is faulty. The same applies to the speakers 5. In other words, for the speaker S4, it can be determined that the speaker is faulty, and for the speaker S3, it can be determined that the control sound output unit 14 is faulty.

In this way, it is possible to narrow down which location in the noise reduction device 10 is faulty to some extent. Therefore, maintenance work such as removing and replacing the speakers 5 and microphones 7 can be made more efficient.

Note that although the external device test is performed first in Step S101 described above, the external device test may be performed after the internal device test.

As described above, if a fault is detected in Step S101 illustrated in FIG. 9 (Yes at S102), processing proceeds to Step S103. If no fault is detected (No at S102), processing proceeds to Step S104.

At Step S103, the noise reduction device 10 sends fault detection information, which includes the internal loop fault information and the external loop fault information, to the management device 80 of the management system 8 that acts a host system (S103).

Then, the noise reduction device 10 starts noise reduction processing. The noise reduction processing starts when, for example, an instruction is sent from the management device 80 indicating that the aircraft 100 has taken off, finished ascending and is at cruising altitude.

Figure 12:
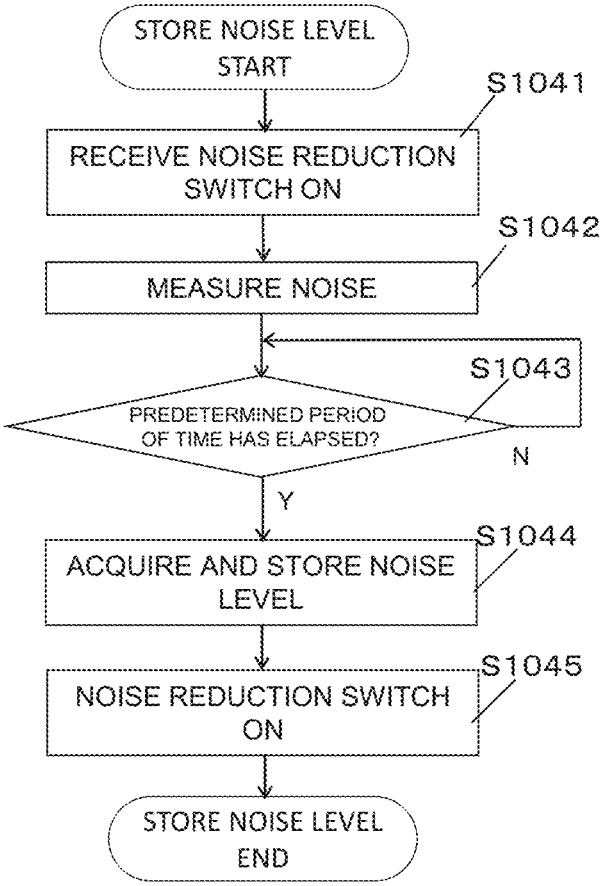
FIG. 12 is a flowchart for illustrating operation of detecting faults using the noise reduction device according to the first embodiment.

FIG. 12 illustrates processing (S104) for analyzing sound signals acquired from the noise microphones 7*a* (FIG. 3) and storing the noise level of said sound signals. As illustrated in FIG. 12, when the noise reduction device 10 receives an instruction to turn ON noise reduction processing (S1041), the noise reduction device 10 acquires a sound signal from the sound receiver 12 before switching ON the noise reduction switch 50 and without using the control sound generator 13 to generate a control sound signal for a predetermined period of time. The noise reduction device 10 stores the noise level of the acquired sound signal in the performance storage unit 23 in the memory 20 as a predetermined noise level (S1042 and S1043). After a predetermined period of time has elapsed after storing the predetermined noise level (S1044), the noise reduction device 10 turns ON the noise reduction switch 50 (S1045).

Returning to FIG. 9, after the predetermined noise level has been stored and noise reduction processing has started, the control sound calculation unit 13*b* analyzes the sound signal acquired from the error microphone 7*b* (FIG. 3) to identify the noise level of the signal and acquire the noise reduction value, which is the different between the noise level of the signal and the predetermined noise level (S105). Then, the fault detector 112 determines if the acquired noise reduction value is less than a noise reduction threshold value for determination stored in advance in the performance storage unit 23 (S106). If the noise reduction value is more than or equal to the threshold value, processing proceeds to Step S108. If the noise reduction value is less than the threshold value, the noise reduction information is sent to the management device 80 (S107). The noise reduction device 10 iterates the processing from Steps S105 to S108 until the noise reduction system 1 is stopped (S108).

Note that the steps in the flowcharts illustrated in FIG. 9 to FIG. 12 are not limited thereto. Some steps may be replaced with other steps or executed in parallel with other steps.

1-3. Characteristics

The noise reduction device 10 according to Embodiment 1 detects a fault in at least one of the microphones 7, the sound receivers 12, the speakers 5, and the control sound output units 14 and sends fault detection information to the management device 80. Therefore, faulty devices can be identified without the need to provide additional devices or steps, which reduces maintenance work and shortens the time required for maintenance.

The noise reduction device 10 sends information indicating the effect of noise reduction to the management device 80 while executing the noise reduction processing. Therefore, faulty devices or devices with reduced performance can be identified, and maintenance work can be reduced and the time required for maintenance can be shortened.

2. Embodiment 2

A noise reduction system according to Embodiment 2 is described with reference to FIGS. 14 to 19. Components and functions that are the same as those in Embodiment 1 are denoted by the same reference symbols and a description thereof is omitted herein.

A noise reduction system 201 according to Embodiment 2 has the functions of the noise reduction system 1 according to Embodiment 1 and further controls the generation of control sound and the input/output of sound on the basis of seat information that is sent from a seat control system 3.

2-1. Configuration

Figure 14:
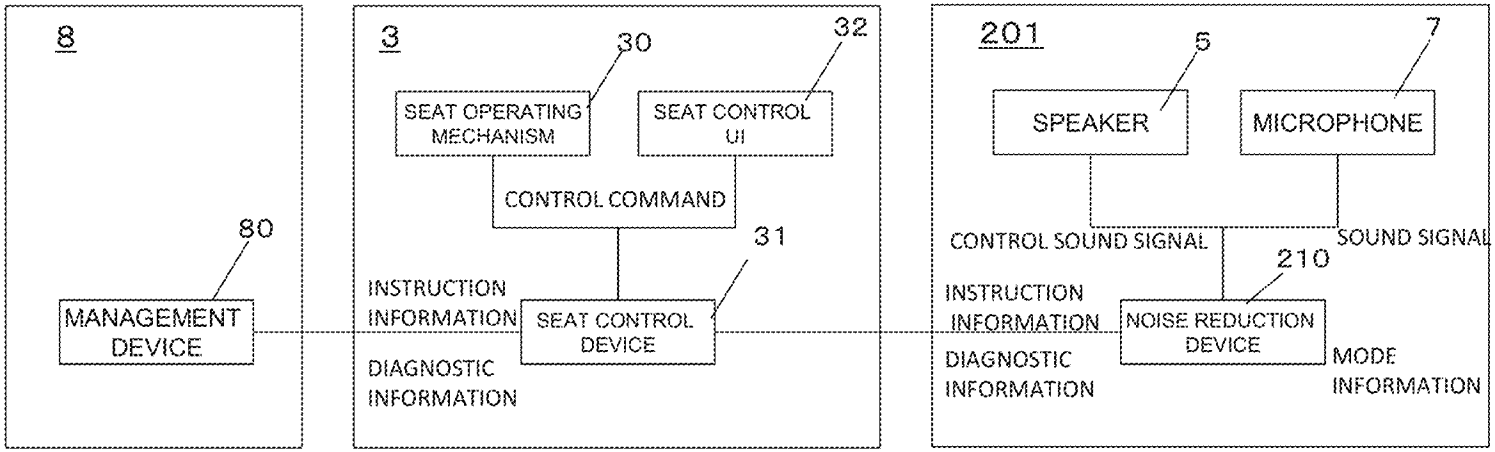
FIG. 14 schematically illustrates the configuration of a noise reduction system according to a second embodiment.

As illustrated in FIG. 14, the noise reduction system 201 is connected to the seat control system 3, and the seat control system 3 includes a seat control device 31, a seat operating mechanism 30, and a seat control UI 32. The seat control system 3 is connected to the management system 8. The management system 8 includes the management device 80.

The noise reduction system 201 includes a noise reduction device 210, the plurality of speakers 5, and the plurality of microphones 7.

Figure 15:
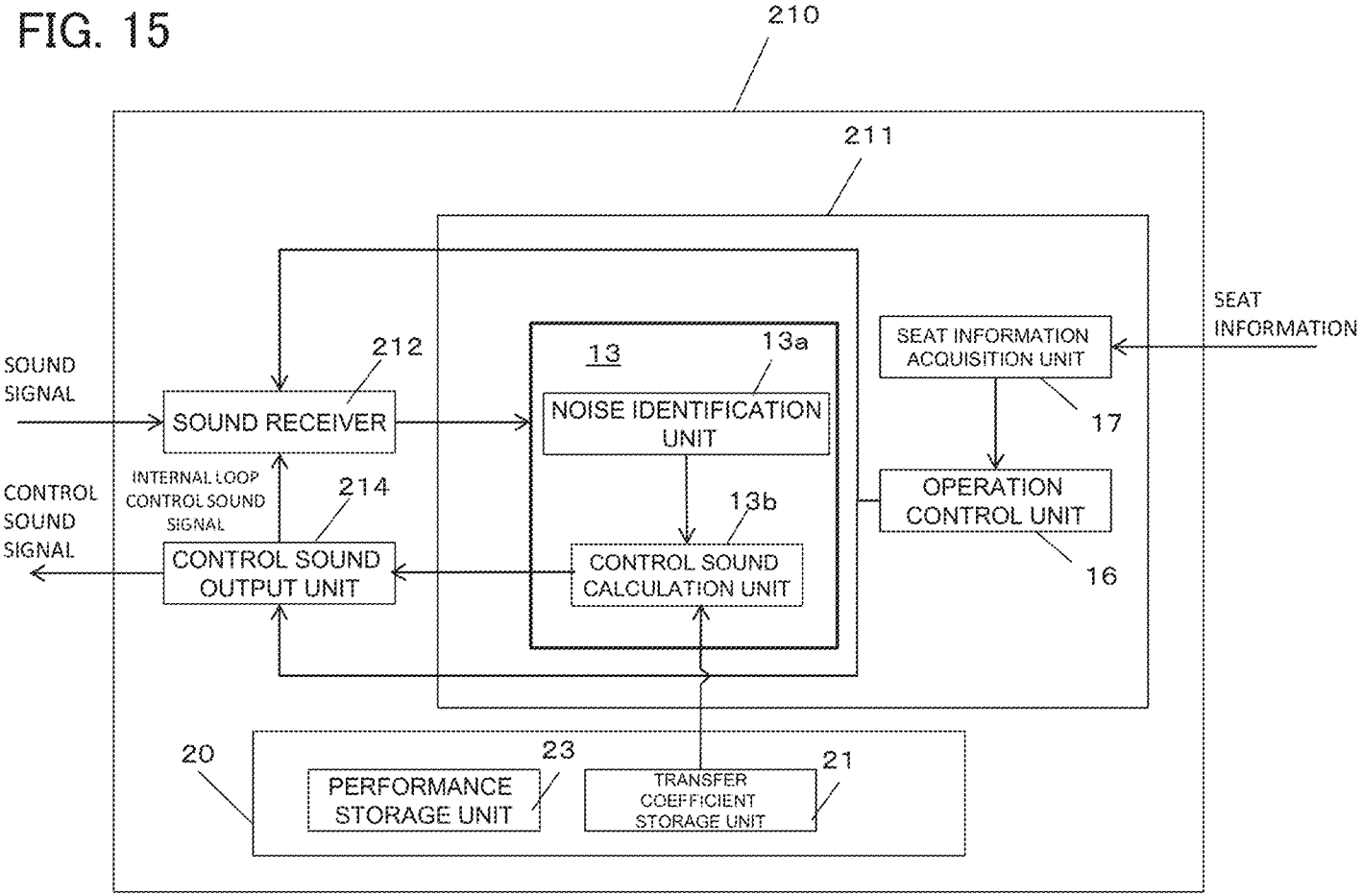
FIG. 15 is a block diagram for illustrating the function of a noise reduction device according to the second embodiment.

As illustrated in FIG. 15, the noise reduction device 210 includes a DSP 211, sound receivers 212 that are respectively connected to the microphones 7, control sound output units 214 that are respectively connected to the speakers 5, and the memory 20.

The sound receivers 212, the DSP 211 and the control sound output units 214 function differently to those in Embodiment 1 in the following ways.

The sound receiver 212 switches ON/OFF input of sound signals from microphones 7 according to an instruction that is output from an operation control unit 16.

The DSP 211 processes digital signals according to a predetermined program to perform the functions of the operation control unit 16 and a seat information acquisition unit 17.

The operation control unit 16 determines operations and operation classifications for each speaker 5 and microphone 7 according to the seat information output from the seat control system 3, and outputs instructions to the sound receiver 212 and the control sound output unit 214. Switching between operations includes switching ON/OFF the output of control sound signals to the speakers 5 and switching ON/OFF the input of sound signals from each microphone 7. Switching between operation classifications includes determining if a microphone 7 is a noise microphone 7*a* or an error microphone 7*b* in FIG. 3 and causing the control sound generator 13 to generate control sound according to the result of that determination. More specifically, when a sound signal is received from a noise microphone 7*a*, the sound signal is processed by the noise identification unit 13*a* and filtered in the control sound calculation unit 13*b* to generate a control sound signal. When a sound signal is received from an error microphone 7*b* (FIG. 3), the filter coefficient is adjusted by the control sound generator 13 such that the sound signal, which is an error noise, is minimized.

The seat information acquisition unit 17 acquires seat information that is sent from the seat control system 3. FIG. 16 illustrates an example of seat information. The seat information includes information that indicates the reclined state of a seat. The seat information may include, for example, a seat number, mode information that indicates the reclined state of the seat, the angle of the seat, weight information, and other types of information. The mode information and information on the angle of the seat is updated each time the seat changes. FIG. 17 illustrates mode information on a seat. For example, the seat has an "upright" mode, a "relax" mode and a "bed" mode. In the upright mode, the back of the seat is in a substantially upright state and the angle of the seat is, for example, from 110 degrees to 150 degrees. In the bed mode, the back of the seat is in a substantially flat state and the angle of the seat is, for example, from 161 degrees to 180 degrees. In the relax mode, the back of the seat is inclined at an angle between the bed mode and the upright mode and the angle of the seat is, for example, from 151 degrees to 160 degrees. The range of the seat angle in each mode is not limited to that described above. For example, the seat angle range in the upright mode or the bed mode may be smaller and the seat angle range in the relax mode may be larger.

In this embodiment, mode information is the type of seat information used as information for identifying the reclined state of the seat, but the information for identifying the reclined state of the seat may be another type of information. For example, the operation control unit 16 may directly acquire information on the angle of the seat and switch the operation and operation classification of each speaker 5 and each microphone 7 according to the acquired angle. The angle of the seat may be acquired from, for example, an acceleration sensor located in the seat. In addition, information on the angle of the seat may be acquired by calculating the angle of the seat from a change in weight of, for example, the back of the seat or the seat cushion based on weight information of the seat.

The mode information on the seat is not limited to that described above and more or less modes than those in the above-described example may be provided. For example, only two modes such as the upright mode and the bed mode may be used.

The control sound output unit 214 switches ON/OFF output of sound signals from each speaker 5 according to an instruction from the operation control unit 16.

Switching ON/OFF output of control sound signals to the speakers 5 and input of sound signals from the microphones 7 is not limited to enabling/disabling the input/output of signals using the noise reduction device 210. For example, the noise reduction device 210 may control ON/OFF of power sources of the speakers 5 and the microphones 7.

As illustrated in FIG. 14, the noise reduction system 201 is connected to the seat control system 3. The seat control system 3 is installed in the seat 105 and includes the seat operating mechanism 30, the seat control device 31, and the seat control user interface (UI) 32. The seat operating mechanism 30 is a mechanism that changes the angle of the seat 105 according to a control command output from the seat control device 31. The seat control device 31 includes a processor such as a CPU and a memory and operates according to a predetermined program. The seat control device 31 outputs a control command to the seat operating mechanism 30 according to command information that is output from the seat control UI 32. This control command indicates, as illustrated in FIG. 18 for example, details of an operation performed on the seat operating mechanism 30. The seat control device 31 further sends seat information based on the command information output from the seat control UI 32 to the noise reduction system 201. The seat control UI 32 is a portion that is operated by a passenger using a button, a switch or a lever. The seat control UI 32 may include a display that has a touch panel as an operation unit. As illustrated in FIG. 19, for example, the instruction information output by the seat control UI 32 is instruction information generated based on the operation of various buttons.

2-2. Operation

After the seat information has been acquired from the seat control system 3, the noise reduction device 210 performs the function of the operation control unit 16 and determines the mode that indicates the reclined state of the seat. The noise reduction device 210 controls operation of the speakers 5 and the microphones 7 according to the determined mode. Controlling operation herein includes turning ON/OFF output of control sound signals to the speakers 5, turning ON/OFF input of sound signals from the microphones 7, and determining if the sound signals from the microphones 7 are from a noise microphone 7*a* or an error microphone 7*b*. When a sound signal is input from a microphone 7 that has been turned ON, the operation control unit 16 determines if the input sound signal was input from a noise microphone 7*a* or an error microphone 7*b*. If the sound signal was input from a noise microphone 7*a*, processing is executed by the above-described noise identification unit 13*a* and the control sound calculation unit 13*b*. If the sound signal was input from an error microphone 7*b*, the control sound calculation unit 13*b* executes control sound calculation processing, which includes adjusting the filter coefficient. In the control sound calculation processing, a control sound signal having a phase opposite to that of a sound signal, which is a noise signal acquired from the noise microphone 7*a*, is generated on the basis of the sound signal and a noise signal acquired from the error microphone 7*b*. The noise reduction device 210 outputs this control sound signal to a speaker 5 that has been turned ON by the control sound output unit 214. The speaker 5 that has been turned ON outputs a control sound.

2-3 Features

The noise reduction device 210 according to this embodiment controls the operation of the speakers 5 and the microphones 7 on the basis of seat information. As a result, operation of the microphones 7 and the speakers 5 can be changed based on a changed control point for noise reduction processing, even if the position of the control point (for example, the position of a head H of a passenger in the seat illustrated in FIG. 3) has changed due to a change in the reclined state of the seat. Therefore, it is possible to maintain the effect of noise reduction.

OTHER EMBODIMENTS

Embodiments of the present invention have been described above to exemplify the technology disclosed in the present application, but the technology herein is not limited to that described above and may also be applied to embodiments in which said technology has been changed, replaced, added or omitted as needed. In addition, components in the above-described embodiments may be combined to form new embodiments.

The noise reduction device 10 according to Embodiment 1 illustrated in FIG. 8 executes an external device test, an internal device test and a noise reduction performance test (FIGS. 9 to 12), but the noise reduction device 10 may be a device that only executes the external device test and the internal device test, or a device that only executes the noise reduction performance test. Alternatively, the noise reduction device 10 may be a device that only executes the external device test or a device that only executes the internal device test.

The noise reduction system 1 is described above as including the noise reduction device 10, the speakers 5 and the microphones 7, but the noise reduction system 1 may further include the seat control system 3.

The arrangement, quantity, operation and operation classification of the speakers 5 and the microphones 7 are not limited to the examples described above and may be changed provided that the effect of reducing noise based on the reclined state of the seat can still be achieved.

In the above-described embodiments, the noise reduction device 10, 210 and the noise reduction system 1, 201 are used as examples of the present technology, but the present disclosure also includes a noise reduction control method that is executed by the noise reduction device 10 or the noise reduction system 1.

In the above-described embodiments, the noise reduction system 1, 201 according to the present disclosure is installed in the seating cabins A to C in the aircraft 100 as one example, but the present disclosure is not limited thereto. The noise reduction system 1, 201 may be installed in the cockpit of an aircraft to reduce the level of noise to which the pilots are exposed. Alternatively, the noise reduction system 1, 201 may be installed in a vehicle other than an aircraft, such as a helicopter, a train or a bus. Further, the noise reduction system 1 is not limited to being installed in a moving body such as a vehicle and may be installed in a building neighboring, for example, a construction site or a concert hall that emits noise.

In Embodiments 1 and 2, some or all of the processing for each functional block may be executed by a program. Further, some or all of the processing for each functional block in the above-described embodiments may be executed by a processor in a computer. The program for executing this processing may be stored in a storage device such as a hard disk or a ROM and run by being read out by the ROM or a RAM.

In Embodiments 1 and 2, the processor described as a DSP or CPU may be replaced with a processor that is configured as a dedicated electronic circuit designed to implement predetermined functions. The processor may be made up of one or a plurality of processors.

The meaning of the term "device" herein encompasses a collection of multiple components (devices, modules (parts), etc.). All of these components may be located in the same housing. A "system" may refer to both a plurality of devices located in separate housings and connected to each other via a network, and one device in which a plurality of modules are located in one housing.

What is claimed:

1. A noise reduction device that generates and outputs a control sound signal for reducing noise, the device comprising:

a sound receiver including a reception circuit for receiving a microphone sound signal acquired by a microphone;

a control sound output unit including an output circuit for outputting the control sound signal to a speaker;

a processor including a circuit for generating the control sound signal based on the microphone sound signal, the processor configured to:

generate a predetermined signal, control an internal loop in which a pre-output control sound signal is input to the sound receiver without the microphone sound signal being received, the pre-output control sound signal being acquired from the control sound output unit prior to being output to the speaker, measure an input level of the microphone sound signal, measure an input level of the pre-output control sound signal that has been input to the sound receiver in the internal loop, and detect a fault in at least one of the microphone, the sound receiver, the speaker, and the control sound output unit, by using the measured input level of the microphone sound signal and the measured input level of the pre-output control sound signal; and a transmitter for transmitting a result of detection of the fault to a management device.

2. The noise reduction device according to claim 1, wherein the sound receiver includes a plurality of sound receivers that receive microphone sound signals from a plurality of the microphones respectively; and the control sound output unit includes a plurality of control sound output units that output control sound signals to a plurality of the speakers respectively.

3. The noise reduction device according to claim 1, wherein the processor is configured to detect a fault in the microphone or the speaker when the measured input level of the microphone sound signal is less than or equal to a predetermined value and also when the measured input level of the pre-output control sound signal is greater than the predetermined value.

4. The noise reduction device according to claim 3, wherein the processor is configured to detect a fault in the sound receiver or the control sound output unit when the measured input level of the pre-output control sound signal is less than or equal to the predetermined value.

5. The noise reduction device according to claim 1, further comprising:

a memory for storing a predetermined noise level, wherein the processor is configured to acquire a noise level of the microphone sound signal and send, via the transmitter, noise reduction information to the management device when a difference between the predetermined noise level and the noise level of the microphone sound signal is less than a predetermined threshold value, and wherein the noise reduction information includes information that indicates at least the difference.

6. The noise reduction device according to claim 5, wherein:

the microphone includes a noise microphone and an error microphone; and the processor is configured to acquire a noise level of a microphone sound signal at the error microphone and send, via the transmitter, the noise reduction information to the management device when a difference between the predetermined noise level and the noise level of the microphone sound signal is less than the predetermined threshold value.

7. The noise reduction device according to claim 5, further comprising:

a switch for switching ON/OFF the noise reduction device, wherein, when acquiring an instruction to turn ON the switch, the processor is configured to acquire the microphone sound signal without generating the control sound signal for a predetermined period of time and stores the noise level of the microphone sound signal in the memory as the predetermined noise level.

8. The noise reduction device according to claim 5, wherein the processor is configured to store in the memory a noise level of a microphone sound signal acquired from the microphone that is furthest away from the speaker as the predetermined noise level.

9. The noise reduction device according to claim 5, wherein the transmitter sends, to the management device, information indicating at least one of the predetermined threshold value, the predetermined noise level, the difference between the predetermined noise level and the noise level of the microphone sound signal, and information on time at which the difference was acquired.

10. The noise reduction system according to claim 1, wherein the processor is configured to control the internal loop in which the pre-output control sound signal is input to the sound receiver while input to the sound receiver from the microphone is turned OFF.

11. A noise reduction system, comprising:

the noise reduction device of claim 1, the noise reduction device being installable in a moving body;

one or more microphones and one or more speakers that are connectable to the noise reduction device; and a management device that is connectable to the noise reduction device and includes a display unit for displaying the result of detection of the fault.

12. The noise reduction system according to claim 11, wherein the display unit displays information that indicates the result of detection of the fault, and the information indicating the result of detection of the fault includes information that identifies at least one of a faulty microphone, a faulty sound receiver, a faulty speaker, and a faulty control sound output unit.

13. The noise reduction system according to claim 11, wherein the display unit displays information that indicates at least one of a predetermined noise level, a difference between the predetermined noise level and a noise level of the microphone sound signal, information on time at which the noise level of the microphone sound signal is acquired, a predetermined threshold value as a reference for determining an effect of noise reduction, positional information on the moving body that is installed with the noise reduction device at the time the noise level of the microphone sound signal is acquired, a velocity of the moving body at the time the noise level of the microphone sound signal is acquired, and information on a seat installed with the noise reduction device.

14. A fault detection method for a noise reduction device that generates and outputs a control sound signal for reducing noise, the method comprising:

receiving a microphone sound signal acquired by a microphone by a reception circuit;

outputting the control sound signal to a speaker by an output circuit;

generating the control sound signal based on the microphone sound signal;

generating a predetermined signal;

controlling an internal loop in which a pre-output control sound signal is input to the sound receiver without the microphone sound signal being received, the pre-output control sound signal being a control sound signal acquired prior to being output to the speaker;

measuring an input level of the microphone sound signal;

detecting a fault in at least one of the microphone, the reception circuit, the speaker, and the output circuit, using the input level of the microphone sound signal and the input level of the pre-output control sound signal; and sending a result of detection of the fault to a management device.

* * * * *